US005984617A

United States Patent [19]

Seaberg

[11] Patent Number: 5,984,617

[45] Date of Patent: Nov. 16, 1999

[54] CLAMP FOR HANDLING STACKED LOADS OF DIFFERENT SIZES AT DIFFERENT MAXIMUM CLAMPING FORCES

[75] Inventor: Richard D. Seaberg, Brush Prairie, Wash.

[73] Assignee: Cascade Corporation, Portland, Oreg.

[21] Appl. No.: 09/076,000

[22] Filed: May 11, 1998

[51] Int. Cl.[6] ..... B66F 9/18

[52] U.S. Cl. ..... 414/623; 294/88; 294/87.1; 901/37

[58] Field of Search ..... 414/618, 620, 414/623, 621, 736; 901/37; 294/88, 87.1; 91/511, 437, 517, 519, 508, 170 R

[56] References Cited

U.S. PATENT DOCUMENTS

| | | | |
|---|---|---|---|
| 2,706,060 | 4/1955 | Ferrario et al. . | |
| 3,583,586 | 6/1971 | Burton . | |
| 3,990,594 | 11/1976 | Olson et al. . | |
| 4,127,205 | 11/1978 | Farmer et al. . | |
| 4,318,661 | 3/1982 | Helm . | |
| 4,397,495 | 8/1983 | Lewis . | |
| 4,682,931 | 7/1987 | House | 414/623 |
| 4,748,570 | 5/1988 | Shochi et al. | 294/88 X |
| 5,308,132 | 5/1994 | Kirby et al. | 901/37 X |
| 5,335,955 | 8/1994 | Pekka et al. | 901/37 X |
| 5,417,464 | 5/1995 | Seaberg et al. | 294/88 |

FOREIGN PATENT DOCUMENTS 2578824 9/1986 France .

*Primary Examiner*—Frank E. Werner
*Attorney, Agent, or Firm*—Chernoff, Vilhauer, McClung & Stenzel

[57] ABSTRACT

A load clamp has two selectively openable and closable opposing clamping assemblies, one of which comprises at least a pair of clamp arms movable separately from each other toward and away from the other clamping assembly. Separate actuators for the respective clamp arms are controlled automatically by a regulator in such a way that the respective closure movements of the arms are simultaneous. A selective adjuster assembly enables the operator to select alternate different maximum magnitudes of clamping force to be imposed by the clamp arms on different loads. An override assembly overrides the regulator to permit nonsimultaneous clamp arm movement, automatically in response to resistance to closure by one of the clamp arms, independently of selective variation of such adjuster assembly. Such independence is achieved by overriding the regulator automatically in delayed response to a magnitude of clamping force which is less than the different maximum magnitudes selectable by the adjuster assembly, the delay in response being sufficient to enable such different magnitudes to be attained in accordance with the operator's selection.

14 Claims, 3 Drawing Sheets

CLAMP FOR HANDLING STACKED LOADS OF DIFFERENT SIZES AT DIFFERENT MAXIMUM CLAMPING FORCES

BACKGROUND OF THE INVENTION

The present invention is directed to a lift truck-mounted load-handling clamp adapted for handling stacked loads of different sizes simultaneously, such as two stacked paper rolls of abbreviated length and different diameters. More particularly, the invention is directed to an improvement in the clamp disclosed in U.S. Pat. No. 4,682,931, which is hereby incorporated by reference, in order to facilitate the selection by the operator of different maximum magnitudes of clamping force to prevent damage to the loads from overclamping.

A common requirement in the paper industry is the handling of half-length paper rolls, which are normally handled by a lift truck roll clamp in pairs having different diameters, stacked one atop the other. Lift truck paper roll clamps specially adapted for handling such stacked rolls have been available in the past and normally consist of a pair of separately-actuated clamp arms on one side of the clamp, in opposed relation to a single, larger clamp arm assembly on the opposite side of the clamp. The separately-actuated arms give the clamp the ability to apply clamping force to two cylindrical objects of different diameters stacked one atop the other. Similar clamping capabilities can be useful with respect to other types of loads, such as stacked pairs of bales or cartons of different sizes.

The above-mentioned U.S. Pat. No. 4,682,931 provides a solution to a problem previously experienced by clamps of this type due to their inability to attain the required clamping force on one of the separately-actuated clamp arms without attaining it also on the other separately-actuated arm. For example, such clamp structures have the separately-actuated clamp arms powered by separate hydraulic cylinders connected in parallel to a source of pressurized fluid, requiring that the pressure buildup in the two cylinders during clamping be identical. The problem with such a structure is that, if only a single half-length roll or other load is to be handled, clamping pressure on the load-engaging arm cannot be attained until the other arm is closed to its maximum extent, which is very time-consuming. Conversely, on opening of the clamp arms to release a load, the release of both clamp arms is not usually simultaneous due to different frictional resistances in the respective arm mechanisms, sometimes requiring full opening of one clamp arm before the other can release sufficiently to disengage the load.

The above-mentioned U.S. Pat. No. 4,682,931 offered a solution to these prior problems by providing a flow regulator of the divider/combiner type which required the respective movements (or lack thereof) of the pair of clamp arms to be simultaneous until the regulator was overridden by an override assembly automatically in response to the attainment of a predetermined clamping force by one of the clamp arms, after which nonsimultaneous movement of the clamp arms was enabled by the override assembly.

However, a significant drawback to the system of U.S. Pat. No. 4,682,931 developed when it became important for clamping systems to have easily-operable selectively-variable clamping force adjustment systems, usually of the multipressure relief type, so that the operator could quickly select a different predetermined maximum magnitude of clamping force for each different load to prevent damage to the load from overclamping. The override assembly of the '931 patent, due to its automatic responsiveness to the attainment of a predetermined clamping force and its inability to change its responsiveness to accommodate higher or lower clamping forces without time-consuming adjustment, could not operate properly independently of the operator's alternating selections of different maximum clamping forces for each different load. For example, if the override assembly were adjusted to operate in response to the attainment by one of the clamp arms of a clamping force lower than the maximum force selected by the operator, the override assembly would operate prematurely to shunt pressurized fluid to the other clamp arm before the operator's selected maximum clamping force could be attained. Alternatively, such override assembly would not operate at all if it were adjusted to operate in response to a clamping force higher than the maximum force selected by the operator, since such clamping force would not be attained in view of the operator's selection.

Another drawback to the system of U.S. Pat. No. 4,682,931 was that, when opening the clamp arms, the maximum opening force attainable by each clamp arm was limited by the pressure limit of the divider/combiner flow regulator valve in its combining mode, unless the other clamp arm had been opened completely. This was because fluid pressure tending to open the clamp arms in parallel was limited to that which opened the clamp arm having the least resistance to opening. If it were desired to push a load with the back of a first clamp arm, referred to as "backhanding" the load, while the second clamp arm encountered no such loading, the only resistance to opening of the second clamp arm, unless it were fully opened, was that imposed by the pressure of the fluid exhausted from the second clamp arm's fluid actuator during opening. Such exhaust pressure was dependent upon the pressure limit of the flow regulator.

BRIEF SUMMARY OF THE INVENTION

The present invention overcomes the foregoing drawbacks by compatibly providing a selectively-variable clamping force adjuster assembly, enabling the operator to selectively predetermine different maximum magnitudes of clamping force, with an override assembly which operates to override the regulator to enable nonsimultaneous movement of the clamp arms independently of selective variations of the adjuster assembly by the operator.

According to a separate aspect of the invention, such independence is achieved by overriding the regulator automatically in delayed response to a magnitude of clamping force which is less than the different maximum magnitudes of clamping force predeterminable by the adjuster assembly, the delay in response being sufficient to enable such different maximum magnitudes of clamping force to be attained in accordance with the operator's selection.

According to another separate aspect of the invention, in order to enable high backhanding force of the clamp arms a backhanding force controller is capable of predetermining one of more maximum magnitudes of backhanding force independently of the regulator.

The foregoing and other objectives, features, and advantages of the invention will be more readily understood upon consideration of the following detailed description, taken in conjunction with the accompanying drawings.

DETAILED DESCRIPTION OF THE PREFERRED EMBODIMENT

Figure 1:
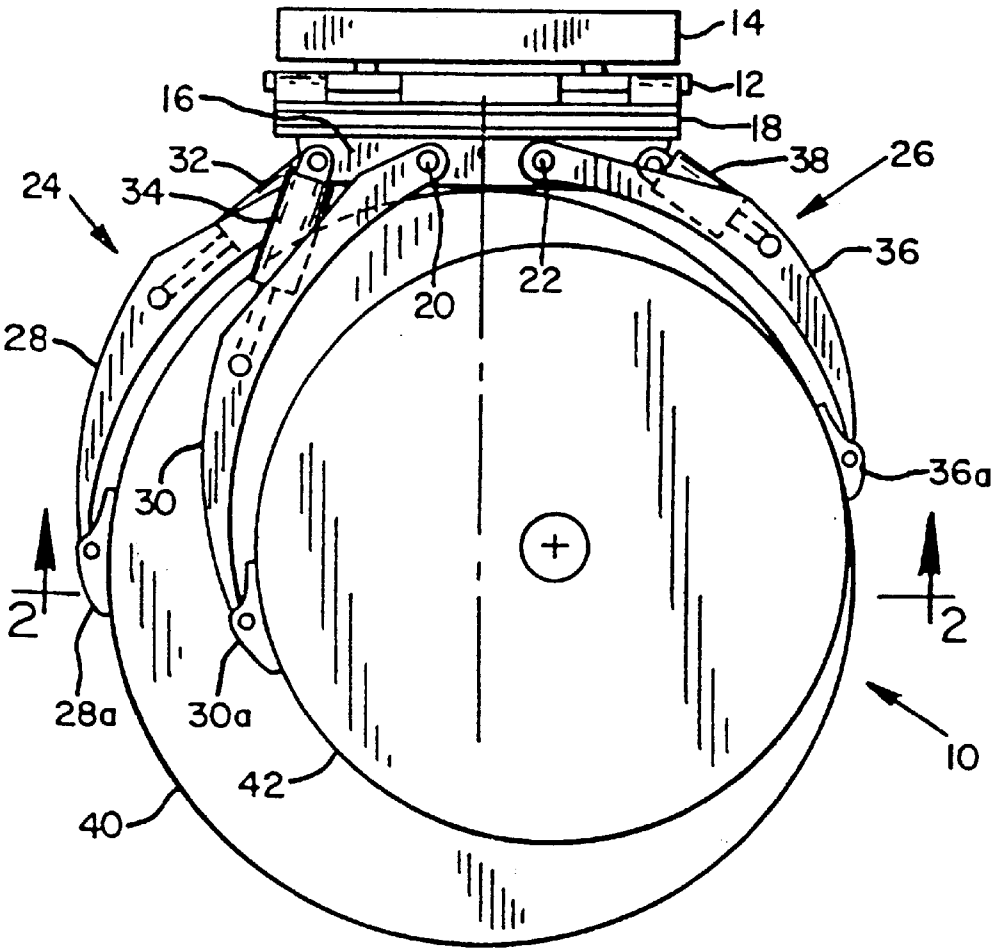
FIG. 1 is a simplified top view of an exemplary split paper roll clamp embodying the present invention, shown in engagement with a pair of stacked rolls of different diameters.

An exemplary paper roll clamp, designated generally as 10 in FIG. 1, is mounted on a vertically-reciprocating carriage 12 carried by a lift truck mast 14. The load clamp comprises a frame 16 mounted on the load carriage 12 connected either fixedly thereto or, as shown in FIG. 1, by a rotator assembly 18. Pivotally mounted to the frame 16 at pivot points 20, 22 are a pair of opposing clamping assemblies designated generally as 24 and 26. The clamping assembly 24 comprises a pair of vertically-spaced clamp arms 28 and 30, having respective load-engagement pads 28*a* and 30*a*, movable separately from each other relative to the frame 16 selectively toward and away from the opposed clamping assembly 26 under the control of fluid power actuators 32 and 34 respectively, each consisting of a double-acting hydraulic cylinder connected between the frame 16 and the respective clamp arms 28 or 30. The opposed clamping assembly 26, on the other hand, consists of only a single clamp arm 36 having an elongated load-engagement pad 36*a* extending vertically so as to oppose the pads of both of the clamp arms 28 and 30. The clamp arm 36 pivots with respect to the frame 16 under the control of a further fluid power actuator 38. Alternatively, the arm 36 could be fixed with respect to the frame 16.

The function of the load clamp 10 is to engage multiple stacked half-length paper rolls, such as 40 and 42, of varying different diameters simultaneously so as to transport them from one location to another. It is also necessary that the clamp be capable of engaging and carrying only a single half-length paper roll, such as roll 40. Carrying of the rolls requires that each be engaged with sufficient clamping force, by the respective pads 28*a*, 30*a* and 36*a*, to be able to support the weight of the loads vertically. The clamping force with respect to pads 28*a* and 30*a* is supplied by the pressure of hydraulic fluid tending to extend hydraulic cylinders 32 and 34, respectively.

The control of cylinders 32 and 34 will first be explained with reference to the preferred embodiment of FIG. 3. A hydraulic pump 44, driven by the lift truck engine, delivers fluid under pressure from a hydraulic reservoir 46 to a manually-operable clamp arm directional control valve 48 shown in its centered, or unactuated condition. A relief valve 50 sets an upper limit on the pressure of the fluid delivered by pump 44 by opening and bleeding fluid back to the reservoir 46 in response to excessive fluid pressure as determined by the variable setting of the relief valve 50.

Figure 3:
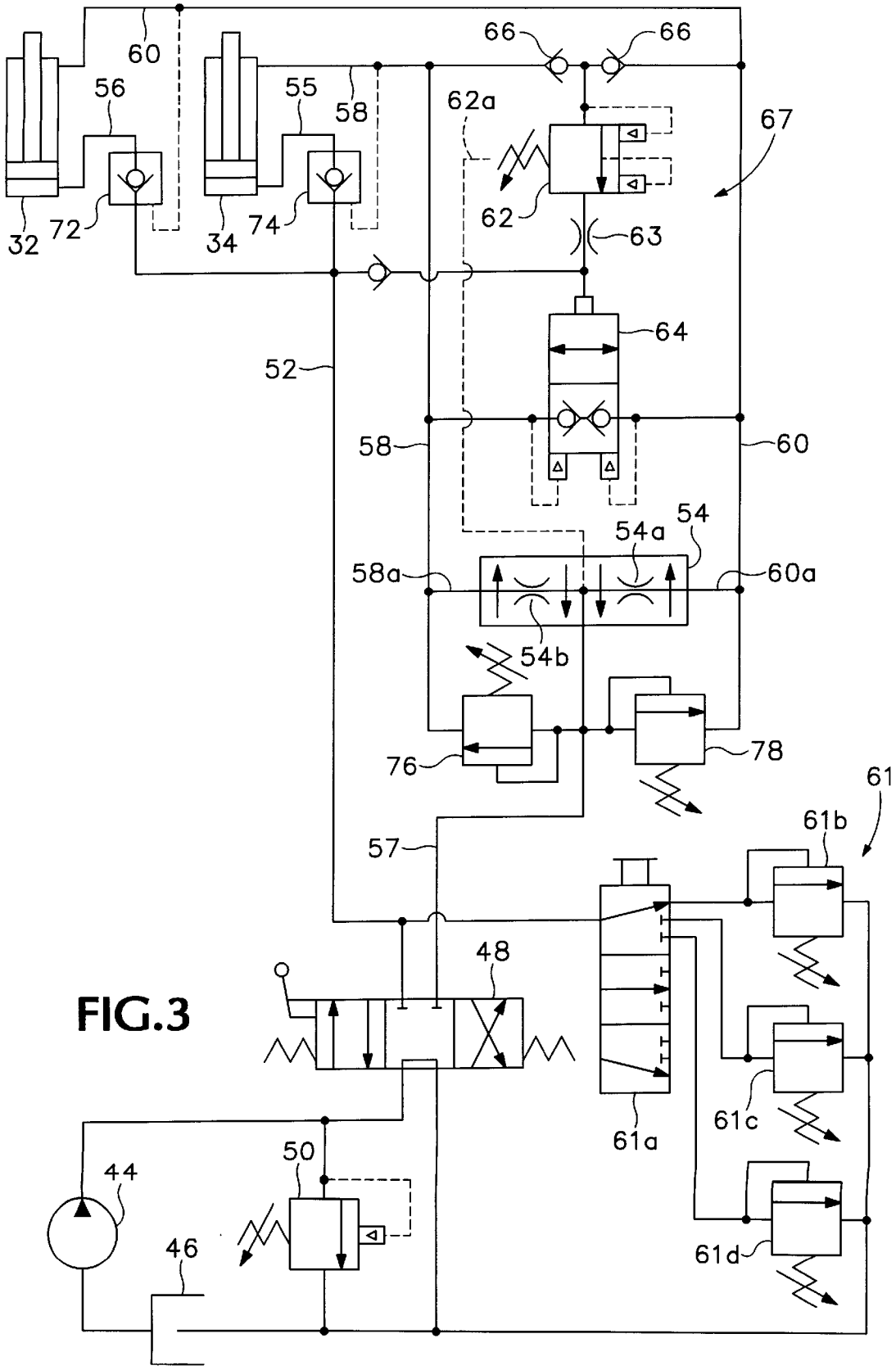
FIG. 3 is a hydraulic circuit diagram of the preferred embodiment of the present invention.

Closing the clamp arms 28 and 30 is accomplished by the lift truck operator's manipulation of valve 48 so as to move its spool to the right in FIG. 3. This delivers pressurized fluid through the input conduit 52 in parallel to lines 56 and 55 to extend hydraulic cylinders 32 and 34 respectively. Simultaneously fluid is exhausted from the opposite sides of cylinders 32 and 34 through respective exhaust lines 60 and 58.

A selectively-variable clamping force adjuster assembly, indicated generally as 61, is preferably a multipressure relief valve assembly consisting of a manually-operable selector valve 61*a* and pressure-relief valves 61*b*, 61*c* and 61*d*. Each of the relief valves 61*b*, 61*c* and 61*d* is set at a different relief pressure, all lower than the relief pressure of valve 50. Each valve 61*b*, 61*c* and 61*d* thus sets a different maximum limit on the pressure of the fluid delivered through line 52 to apply clamping force through the hydraulic cylinders 32 and 34, and thereby predetermines a different maximum clamping force. The operator alternately selects any of the different maximum pressure limits, and thus any of the different maximum clamping forces, suitable for handling any particular load simply by adjusting the selector valve 61*a* to select one of the relief valves 61*b*, 61*c* or 61*d*. Alternatively, an easily-controllable variable pressure-relief valve or pressure-reducing valve could be associated with the conduit 52 for the same purpose.

As pressurized fluid is delivered through the conduit 52 to the hydraulic cylinders 32 and 34, fluid is simultaneously exhausted from the cylinders through the conduits 60 and 58 and through conduits 60*a* and 58*a*, respectively, into a flow regulator consisting of a conventional flow divider/combiner valve 54. The valve 54 combines the flows into a flow which emerges from conduit 57 and is exhausted through valve 48 to the reservoir 46. The valve 54 ensures that the hydraulic cylinders 32 and 34 extend simultaneously, and thus that the clamp arms 28 and 30 advance simultaneously toward the opposed clamp arm assembly 36. The valve 54 also causes the respective volumetric flow rates in conduits 58 and 60 to be proportional to each other and, assuming that the cylinders 32 and 34 are of the same diameter, preferably equal to each other.

Assuming that rolls of different diameters corresponding to rolls 40 and 42 are to be engaged, clamp arm 28 would normally be the first to encounter resistance from the larger-diameter roll 40. This resistance restricts the extension of cylinder 32 and reduces the flow exhausted through conduits 60 and 60*a* and restrictor 54*a* of the valve 54. In response thereto, the valve 54 begins to close restrictor 54*b* to accomplish a corresponding reduction in flow therethrough. When flow through restrictor 54*a* ceases due to the inability of the cylinder 32 to extend further, restrictor 54*b* is substantially closed, thereby likewise preventing further extension of cylinder 34 and further closure of clamp arm 30. At this point the clamp arm 30 has not yet engaged the smaller-diameter roll 42. However, by continued actuation of the directional control valve 48 tending to close the clamp arms, the fluid pressure in conduits 52, 55 and 56 builds up to that which corresponds to the predetermined maximum clamping force adjustably set by the adjuster assembly 61. Due to the closure of restrictor 54*b* the pressure in conduit 58 likewise builds up to a level even somewhat higher than that in conduit 55 due to the pressure amplifying effect of the piston and rod assembly of the hydraulic cylinder 34. The pressure in conduit 58 is applied through a shuttle valve 66 to an override assembly indicated generally as 67 consisting of a sequence valve 62, a delay orifice 63, and an override bypass valve 64. When the pressure in conduit 58 exceeds the setting of the sequence valve 62, the valve opens and, after a delay caused by the orifice 63, moves the valve 64 to its bypass condition to override the flow regulator valve 54. This enables fluid from conduit 58 to flow through valve 64 to conduit 60 and through restrictor 54*a* of the flow regulator valve 54. In response to such flow, regulator valve 54 opens restrictor 54*b* to permit an equal flow therethrough, and hydraulic cylinder 34 is therefore permitted to extend even though cylinder 32 cannot extend further due to the resistance of the larger-diameter roll 40.

The sequence valve 62 of the override assembly 67 must be set to open and thereby override the regulator valve 54 in response to a magnitude of clamping force, represented by the clamping pressure in conduit 52, which is less than the different maximum magnitudes of clamping force predetermined by the maximum pressures selectable by the adjuster assembly 61. Otherwise, sufficient pressure will not be present in conduit 58 to open the sequence valve 62 and operate the override assembly at the lowest clamping pressure selectable by the adjuster assembly 61. By way of example, if the three relief valves 61*b*, 61*c* and 61*d* were set to provide maximum clamping pressures of 800 psi, 1400 psi and 2000 psi, respectively, the setting of sequence valve 62 would be such as to cause the valve 62 to open in response to a clamping pressure of approximately 700 psi in conduit 52.

In view of the necessarily low setting of the sequence valve 62, the delay provided by the delay orifice 63 is necessary to prevent the bypass valve 64 from opening prematurely before higher clamping pressures selected by the adjuster assembly 61 are attained. Otherwise, premature opening of the bypass valve 64 would create a low resistance to extension of the parallel cylinder 34, thus preventing the attainment of the selected maximum clamping pressure and resultant clamping force by cylinder 32. Once the selected predetermined maximum clamping pressure is attained in cylinder 32, it is trapped therein by a pilot-operated check valve 72, after which the delayed opening of the bypass valve 64 occurs to permit the further extension of cylinder 34 without limiting the clamping pressure in cylinder 32.

Although the delay orifice 63 is a preferred structure for accomplishing the needed delay in over-riding the flow regulator 54, other delay-causing structures such as an accumulator could alternatively be employed. Also, instead of the flow divider/combiner valve 54, other hydraulic flow regulators, such as a pair of interconnected rotary flow regulators, could be used in ensure simultaneous proportional flows through conduits 58 and 60.

Cylinder 34 continues to extend until encountering the resistance of roll 42, at which time clamping force is applied and the pressure in conduit 55 rises to a maximum level equal to that in conduit 56, after which the directional control valve 48 may be deactivated and the rolls lifted. If only a single roll 40 were present, the load clamping operation could be halted by deactivation of control valve 48 as soon as sufficient clamping pressure had been built up in conduit 56 upon initial engagement with the roll 40, and there would be no need to further extend the cylinder 34 to further close clamp arm 30.

The override assembly 67 has the same effect on either one of the clamp arms 28 and 30 by virtue of its ability to sense pressure in either conduit 58 or 60 through shuttle valve 66. Thus it would make no difference if the clamp 10 had been inverted by rotator 18 such that the clamp arm 30 is in the lower position for engaging roll 40. In such case, the operation of cylinder 34 and clamp arm 30 would be identical to that just described with respect to cylinder 32 and clamp arm 28, and vice versa.

When the load is to be disengaged, the operator moves the spool of the control valve 48 to the left in FIG. 3, such that pressurized fluid from pump 44 is directed through conduit 57 to the rod end of each hydraulic cylinder 32, 34 to retract it. Pilot-operated check valves 72 and 74 are unseated by the pressure in conduits 60 and 58, respectively, such that fluid can be exhausted simultaneously from the cylinders through conduits 56 and 55. Regulator valve 54, acting now as a divider valve, requires simultaneous flows through conduits 58 and 60 and, if such flows are not simultaneous and proportional, reduces the size of the restrictor 54*a* or 54*b* having excessive flow. This has the effect of raising system pressure to the point necessary to effect retraction of the nonmoving cylinder by overcoming frictional or other forces which are tending to hold it back. Accordingly the regulator valve 54, acting in its dividing mode, causes substantially simultaneous release of the two clamp arms 28 and 30.

Figure 2:
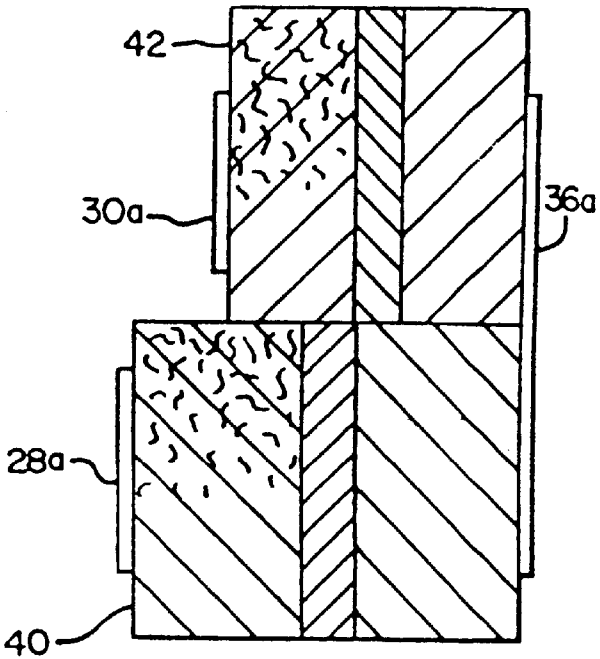
FIG. 2 is a reduced, simplified sectional view taken along line 2—2 of FIG. 1.

If, upon the initiation of opening, the clamp arms are in different positions as shown, for example, in FIGS. 1 and 2, the clamp arms will open simultaneously maintaining their different positions as long as the operator actuates the control valve 48. If one clamp arm, such as 28, is used in a backhanding mode to push a load, causing substantial resistance to further opening, flow to its cylinder 32 through restrictor 54*a* will decrease or cease. Accordingly, the valve 54 tends to close the opposite restrictor 54*b*, restricting or blocking the flow to cylinder 34 because of the requirement by valve 54 for simultaneous flows to the two cylinders. However, unlike the load clamping operation described previously, the regulator valve 54 cannot be overridden by the operator's continued actuation of control valve 48 because opening of the sequence valve 62 is opposed, through drain line 62*a*, by the same pressure tending to open it. Moreover, the regulator valve 54 has no pressure limit above which the restrictors 54*a* and 54*b* can be forced to open. These factors enable a backhanding force controller consisting of variable relief valves 76 and 78 in parallel with the valve 54 to predetermine one or more maximum magnitudes of backhanding force to be imposed by fluid pressure in conduit 57 to open the clamp arms, independently of the regulator valve 54 and independently of the override assembly 67 which is temporarily disabled. For example, if a substantial backhanding force exerted by cylinder 32 is desired while cylinder 34 is experiencing no significant resistance to opening, the relief pressure to which force controller valve 76 is set will ensure the required backhanding pressure in conduit 60 by preventing the loss of pressure through the parallel conduit 58 to cylinder 34. Alternatively, valve 78 sets the desired maximum backhanding relief pressure for cylinder 34. The maximum backhanding relief pressures set by valves 76 and 78 are lower than that of relief valve 50.

Figure 4:
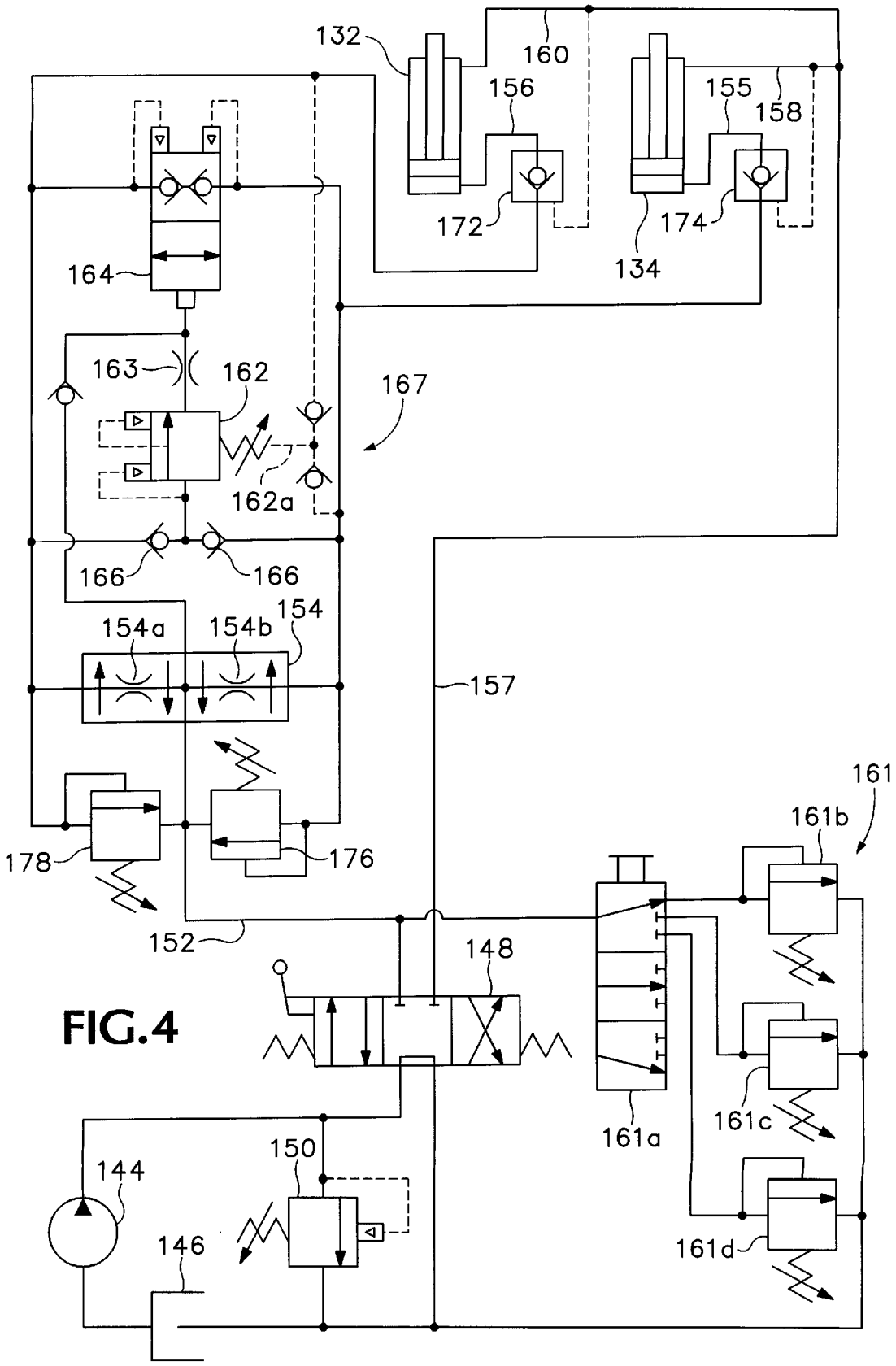
FIG. 4 is a hydraulic circuit diagram of an alternative embodiment of the present invention.

FIG. 4 shows an alternative embodiment of the invention where the fluid regulator 154 and override assembly 167 are interposed in a fluid conduit assembly through which fluid flows to the actuator cylinders 132 and 134, rather than from the cylinder as in FIG. 3, during the load clamping operation. In FIG. 4, those elements corresponding to the elements of FIG. 3 have the same reference numerals as in FIG. 3 increased by 100. In FIG. 4, the flow regulator divider/combiner valve 154 operates in a dividing mode during closure of the clamp arms, receiving pressurized fluid through conduit 152 and dividing it into simultaneous flows through restrictors 154*a* and 154*b* to ensure simultaneous extension of the cylinders 132 and 134. Predetermined different maximum magnitudes of clamping force are selected by means of the adjuster assembly 161. In delayed response to a magnitude of fluid pressure determined by the setting of the sequence valve 162, the override bypass valve 164 can open to permit nonsimultaneous arm closure. As before, even though the setting of valve 162 is less than the different maximum magnitudes of pressure selected by the adjuster assembly 161, the opening of the bypass valve 164 is delayed sufficiently by the orifice 163 to permit the selected maximum clamping pressure to be achieved and trapped by a respective pilot-operated check valve such as 172 or 174.

To open the clamp arms, pressurized fluid is fed in parallel to conduits 158 and 160 from valve 148 and conduit 157 to retract cylinders 134 and 132, simultaneous retraction of the cylinders being ensured by the combining function of regulator valve 154 with respect to the fluid exhausted through conduits 156 and 155 from the cylinders 132 and 134. When the retraction of one cylinder is impeded by backhanding resistance, backhanding force controller relief valve 176 or 178 offers sufficient resistance to the exhaust of fluid from the second cylinder 134 or 132, respectively, that the required backhanding pressure and force can be attained in the first cylinder. As in the embodiment of FIG. 3, the override bypass valve 164 is prevented from opening by opposing pressure in drain line 162*a* when the clamp arms are opening.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A load-handling clamp having a frame liftably mounted upon the lifting apparatus of a lift truck, first and second laterally opposed clamping assemblies mounted upon said frame, the first clamping assembly comprising at least a pair of clamp arms movable separately from each other relative to said frame laterally toward and away from the second clamping assembly, a pair of fluid power actuators, each associated with a respective clamp arm, for moving said clamp arms separately from each other laterally toward and away from the second clamping assembly and imposing clamping force through said clamp arms in a direction laterally toward said second clamping assembly, a fluid regulator connected to said pair of actuators for causing the respective movements of said pair of clamp arms in said direction to be simultaneous with each other, and an override fluid valve assembly capable of overriding said regulator so as to permit one of said pair of clamp arms to move in said direction without simultaneous movement in said direction by the other of said pair of clamp arms, wherein the improvement comprises a selectively-variable fluid pressure-regulating clamping force adjuster assembly associated with said actuators capable of selectively predetermining different maximum magnitudes of said clamping force imposed by said clamp arms, said override fluid valve assembly overriding said regulator automatically in response to resistance to movement in said direction by said other of said pair of clamp arms independently of selective variations of said clamping force adjuster assembly which predetermine said different maximum magnitudes of clamping force.

2. The apparatus of claim 1 wherein said fluid regulator is interposed in a fluid conduit assembly through which fluid flows from said actuators during movement of said clamp arms in said direction toward said second clamping assembly.

3. The apparatus of claim 1 wherein said fluid regulator is interposed in a fluid conduit assembly through which fluid flows to said actuators during movement of said clamp arms in said direction toward said second clamping assembly.

4. The apparatus of claim 1, including a backhanding force controller capable of predetermining one or more maximum magnitudes of force, imposed by at least one of said clamp arms while both of said arms are moving in a direction away from said second clamping assembly, independently of said regulator.

5. A load-handling clamp having a frame liftably mounted upon the lifting apparatus of a lift truck, first and second laterally opposed clamping assemblies mounted upon said frame, the first clamping assembly comprising at least a pair of clamp arms movable separately from each other relative to said frame laterally toward and away from the second clamping assembly, a pair of fluid power actuators, each associated with a respective clamp arm, for moving said clamp arms separately from each other laterally toward and away from the second clamping assembly and imposing clamping force through said clamp arms in a direction laterally toward said second clamping assembly, a fluid regulator connected to said pair of actuators for causing the respective movements of said pair of clamp arms in said direction to be simultaneous with each other, and an override fluid valve assembly capable of overriding said regulator so as to permit one of said pair of clamp arms to move in said direction without simultaneous movement in said direction by the other of said pair of clamp arms, wherein the improvement comprises a selectively-variable fluid-pressure regulating clamping force adjuster assembly associated with said actuators capable of selectively predetermining different maximum magnitudes of said clamping force imposed by said clamp arms, said override fluid valve assembly overriding said regulator automatically in response to a magnitude of said clamping force which is less than said different maximum magnitudes of clamping force predetermined by said clamping force adjuster assembly, said response being delayed sufficiently to enable attainment of any of said different maximum magnitudes of clamping force, as selected by said adjuster assembly, in one of said clamp arms without requiring said attainment in the other of said clamp arms.

6. The apparatus of claim 5 wherein said fluid regulator is interposed in a fluid conduit assembly through which fluid flows from said actuators during movement of said clamp arms in said direction toward said second clamping assembly.

7. The apparatus of claim 5 wherein said fluid regulator is interposed in a fluid conduit assembly through which fluid flows to said actuators during movement of said clamp arms in said direction toward said second clamping assembly.

8. The apparatus of claim 5, including a backhanding force controller capable of predetermining one or more maximum magnitudes of force, imposed by at least one of said clamp arms while both of said arms are moving in a direction away from said second clamping assembly, independently of said regulator.

9. A load-handling clamp having a frame liftably mounted upon the lifting apparatus of a lift truck, first and second laterally opposed clamping assemblies mounted upon said frame, the first clamping assembly comprising at least a pair of clamp arms movable separately from each other relative to said frame laterally toward and away from the second clamping assembly, a pair of fluid power actuators, each associated with a respective clamp arm, for moving said clamp arms separately from each other laterally toward and away from the second clamping assembly and imposing clamping force through said clamp arms in a direction laterally toward said second clamping assembly, a fluid regulator connected to said pair of actuators for regulating respective flows of fluid through said actuators so as to cause the respective movements of said pair of clamp arms in said direction to be simultaneous with each other, and an override fluid valve assembly capable of overriding said fluid regulator so as to permit one of said pair of clamp arms to move in said direction without simultaneous movement in said direction by the other of said pair of clamp arms, wherein the improvement comprises a clamping force fluid pressure adjuster assembly associated with said fluid power actuators capable of selectively predetermining different maximum magnitudes of said fluid pressure causing said actuators to impose said clamping force, said override fluid valve assembly overriding said fluid regulator automatically in response to a magnitude of said fluid pressure which is less than said different maximum magnitudes of fluid pressure predetermined by said adjuster assembly, said response being delayed sufficiently to enable attainment of any of said different maximum magnitudes of fluid pressure, as selected by said adjuster assembly, in one of said actuators without requiring said attainment in the other of said actuators.

10. The apparatus of claim 9 wherein said fluid regulator is interposed in a fluid conduit assembly through which fluid flows from said actuators during movement of said clamp arms in said direction toward said second clamping assembly.

11. The apparatus of claim 10, including a backhanding fluid pressure controller associated with said actuators capable of selectively predetermining one or more maximum magnitudes of fluid pressure, causing said actuators to move said clamp arms away from said second clamping assembly, independently of said fluid regulator.

12. The apparatus of claim 9 wherein said fluid regulator is interposed in a fluid conduit assembly through which fluid flows to said actuators during movement of said clamp arms in said direction toward said second clamping assembly.

13. The apparatus of claim 12, including a backhanding fluid pressure controller associated with said actuators capable of predetermining one or more maximum magnitudes of fluid pressure applied to at least one of said actuators, while both of said actuators are moving said clamp arms away from said second clamping assembly, independently of said fluid regulator.

14. A load-handling clamp having a frame liftably mounted upon the lifting apparatus of a lift truck, first and second laterally opposed clamping assemblies mounted upon said frame, the first clamping assembly comprising at least a pair of clamp arms movable separately from each other relative to said frame laterally toward and away from the second clamping assembly, a pair of fluid power actuators, each associated with a respective clamp arm, for moving said clamp arms separately from each other laterally toward and away from the second clamping assembly and imposing clamping force through said clamp arms in a direction laterally toward said second clamping assembly, a fluid regulator connected to said pair of actuators for causing the respective movements of said pair of clamp arms in said direction to be simultaneous with each other, and an override fluid valve assembly capable of overriding said regulator so as to permit one of said pair of clamp arms to move in said direction without simultaneous movement in said direction by the other of said pair of clamp arms, wherein the improvement comprises a fluid pressure-regulating backhanding force controller capable of predetermining independently of said regulator, one or more maximum magnitudes of force imposed by at least one of said clamp arms while both of said arms are moving in a direction laterally away from said second clamping assembly, said backhanding force controller including at least one pressure-regulating valve connected to at least one of said pair of actuators in parallel with said regulator.

* * * * *